US005133549A

United States Patent [19]

Vasquez

[11] Patent Number: 5,133,549

[45] Date of Patent: Jul. 28, 1992

[54] BALL-HITTING PRACTICE DEVICE

[76] Inventor: Joaquin C. Vasquez, P.O. Box 1060, Los Banos, Calif. 93635

[21] Appl. No.: 660,781

[22] Filed: Feb. 26, 1991

[51] Int. Cl.[5] ..... A63B 69/40

[52] U.S. Cl. ..... 273/26 E; 273/29 A; 273/184 B; 273/185 D; 273/197 A

[58] Field of Search ..... 273/26 E, 178 A, 184 R, 273/184 B, 185 D, 197 R, 197 A, 127 D, 26 R, 29 A

[56] References Cited

U.S. PATENT DOCUMENTS

| | | | |
|---|---|---|---|
| 959,402 | 5/1910 | Sullivan . | |
| 1,777,350 | 10/1930 | Carlond | 273/184 B |
| 1,808,390 | 6/1931 | Volk | 273/184 B |
| 2,633,320 | 3/1953 | Salmi | 248/183 |
| 2,818,255 | 12/1957 | Ponza | 273/26 |
| 3,118,670 | 1/1964 | Smith | 273/26 |
| 3,408,070 | 10/1968 | Gonzales et al. | 273/26 |
| 3,794,320 | 2/1974 | Salmont | 273/29 A |
| 4,460,172 | 7/1984 | Hogan | 273/29 A |
| 4,508,339 | 4/1985 | Llewellyn | 273/26 E |
| 4,679,790 | 7/1987 | Ham | 273/26 E |

*Primary Examiner*—Theatrice Brown
*Attorney, Agent, or Firm*—Schneck & McHugh

[57] ABSTRACT

A ball-hitting practice device having support arms rotatable about an axis with the arm rotation restrained by a torque releasable clutch. The clutch has a fixed clutch plate having a pair of recesses in a surface facing a rotatable clutch plate. The rotatable clutch plate includes a pair of engagement balls adapted to be received within the recesses. A spring biases the clutch plates together. Biasing of the two clutch plates is adjustable for varying of the resistance to unseating the engagement balls from the recesses. A pair of support arms having practice balls mounted thereto by coil springs are attached to the rotatable clutch plate for rotation about a generally horizontal axis. Striking of a practice ball with a level swing causes movement of the practice ball about an arc of 180 degrees to a second rest position. The bias between the clutch plates is adjusted such that a swing that is not level will not effect a 180 degree rotation of a practice ball.

15 Claims, 2 Drawing Sheets

BALL-HITTING PRACTICE DEVICE

TECHNICAL FIELD

The present invention relates to a device for practicing hitting of a ball for development of a level swing.

BACKGROUND ART

There are many variables in the transfer of energy from a swing of a bat to a batted ball. The mass of the bat and the speed of the bat play an important role in achieving a power swing. The point of impact of the ball along the length of the bat is another factor. Ideally, the impact should be between the center of gravity of the bat and the bat's center of percussion, i.e., the place which when hit by the ball produces no recoil at the batter's wrists, other than a twisting action. Equally important is that the bat must be traveling along the same plane as the ball at the time of impact. This is referred to as a "level" swing.

Achievement of a level swing maximizes the component of force in the desired direction of ball travel after impact. Thus, elimination of a downward "chop" or an "uppercut" in a swing will increase the efficiency of a swing.

Devices which assist a player in developing a level swing are known. U.S. Pat. Nos. 3,794,320 to Salmont, 4,460,172 to Hogan and 4,679,790 to Ham all teach training devices on which a practice ball is extended radially from the top of a shaft for rotation around the shaft. Salmont teaches that the shaft should be inclined so that the ball will be returned to an initial position of rest by gravitational force. The maximum rotation allowed by the Salmont device is 180 degrees. Hogan and Ham teach rotation about a vertical axis and utilize springs which return a ball to an initial position. However, none of these devices provides an indication as to whether a player has utilized a level swing in striking a ball.

U.S. Pat. Nos. 2,818,255 to Ponza and 4,508,339 to Llewellyn teach practice devices in which balls are caused to be rotated about a horizontal axis. An indication of energy transfer is provided because the Ponza and Llewellyn devices include cams that require striking of a ball with sufficient force to overcome both gravitational force and force exerted by a spring which biases cam members together. While the devices provide an improvement, the devices may actually act to develop uppercuts in the swings of users. The camming action of the devices requires that a rotatable upper cam member be lifted axially relative to a shaft. This may be done by a level swing that initiates the camming action, or may be done by a lifting during the swing. The "feel" during impact would encourage the uppercut, since it is not natural for a properly struck ball to be lifted upwardly relative to a level swing. That is, the more natural feel would be one in which the bat would follow the path dictated by the upwardly extending contour of the cam surface of the upper cam member.

It is an object of the present invention to provide a ball-hitting practice device which indicates impact of a ball by a bat swung in a fundamentally correct manner and which more closely simulates the natural "feel" of such an impact.

SUMMARY OF THE INVENTION

The above object has been met by a ball-hitting practice device in which a ball is locked in a rest position until struck with a force having a force component in a direction coincident with that imparted by a level swing, wherein that force component must exceed a threshold level.

The ball-hitting practice device includes a pair of support arms fixed to a rotatable clutch plate at first ends and fixed to practice balls at opposite ends. Coil springs link the practice balls to the remainder of the device. The rotatable clutch plate indexes travel of the balls about a generally horizontal axis, with the balls being 180 degrees apart. The rotatable clutch plate includes curved protrusions from an otherwise smooth surface. The curved protrusions may be portions of engagement balls. Parallel to the surface of the rotatable clutch plate is a surface of a fixed clutch plate having a pair of recesses dimensioned to receive the engagement balls. The arrangement of the two surfaces may be reversed. Unlike prior art devices in which a camming action requires a significant axial movement upon striking of the ball, the present invention provides a planar rotation after disengagement from the rest position.

With the engagement balls seated within the recesses, the support arms are held within a vertical rest position. A spring biases the two clutch plate surfaces into contact. The bias may be selectably adjusted, thereby adjusting the force which is necessary to disengage the two clutch plates. However, once disengaged the curved protrusions move smoothly along the surface of the fixed clutch plate. The fixed clutch plate is mounted to a frame to secure the support arms at a level which allows travel about the generally horizontal axis.

A coil spring provides the bias for pressing the clutch plates into contact with each other. The coil spring may be compressed to increase the torque necessary to disengage the rotatable clutch plate from the fixed clutch plate. Preferably, adjustment provides that a level swing is necessary to provide adequate torque for disengaging the clutch plates. The adjustment will be different for each user. However, upon disengagement of the clutch plates after impact of a practice ball with a level-moving bat, the low friction of the engagement ball along the smooth surface of the fixed clutch plate reliably allows continued motion until the engagement balls again engage recesses in the fixed clutch plate. Thus, the clutch plates act as an indexing assembly.

An advantage of the present invention is that the device trains a user to utilize a level swing. When set correctly, a practice ball will travel along an arc of 180 degrees only upon impact by a fundamentally correct swing. Another advantage is that the practice device more closely simulates the natural feel of a baseball swing. Movement of the ball parallel to the horizontal axis of rotation is minimal as compared to the cammed devices of the prior art.

BEST MODE FOR CARRYING OUT THE INVENTION

Figure 1:
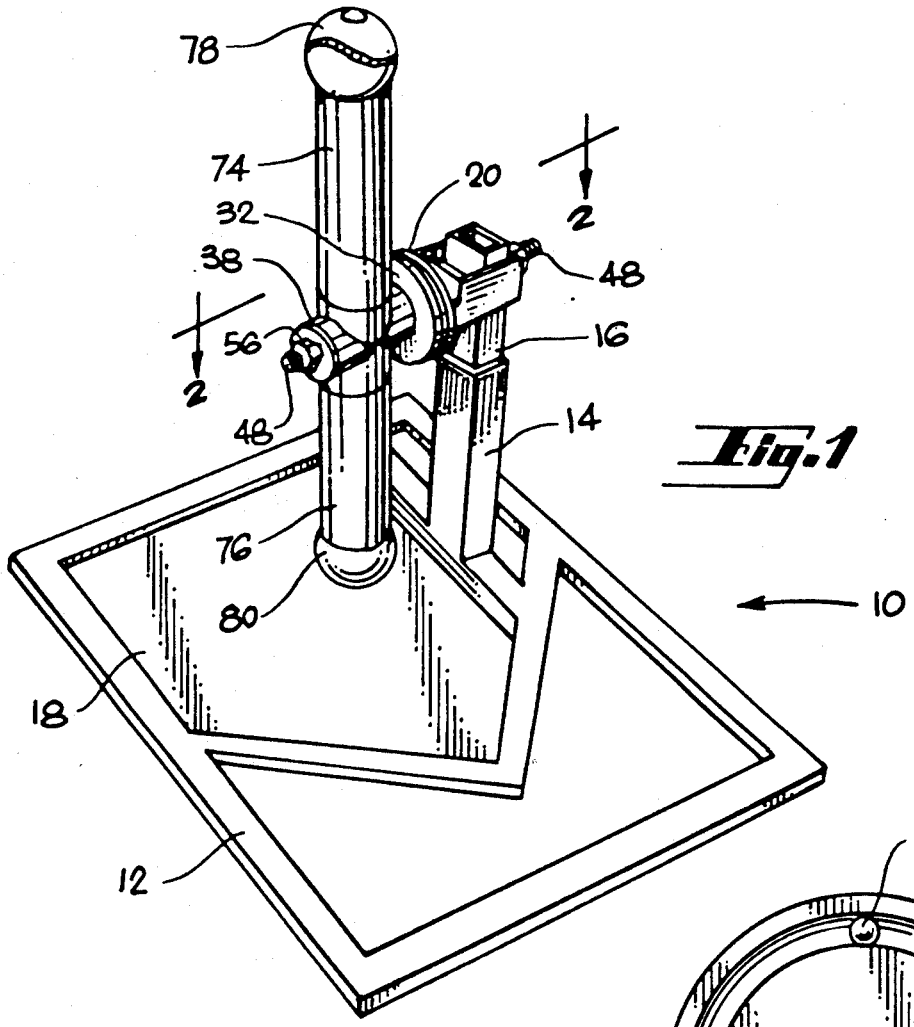
FIG. 1 is a perspective view of a ball-hitting practice device in accord with the present invention.

With reference to FIG. 1, a ball-hitting practice device 10 is shown as having a frame comprising a base member 12 and a pair of telescoping upright members 14 and 16. A five-sided region 18 of the base member 12 has the standardized dimensions of a baseball home plate. Preferably, the five-sided region is made of the same elastomeric material of the baseball home plate. The remainder of the base member 12 stabilizes the practice device 10.

The lower telescoping member 14 is fixed relative to the base member 12. The upper telescoping member 16 is slidably received within the lower telescoping member. While not shown, the two telescoping members 14 and 16 include an array of holes. The relative position of the two members can be selectively fixed by insertion of a bolt within the holes. This allows use of the device 10 by persons of varying height, or allows a single user to vary the height for practice of hitting a ball at different levels above the ground.

Figure 2:
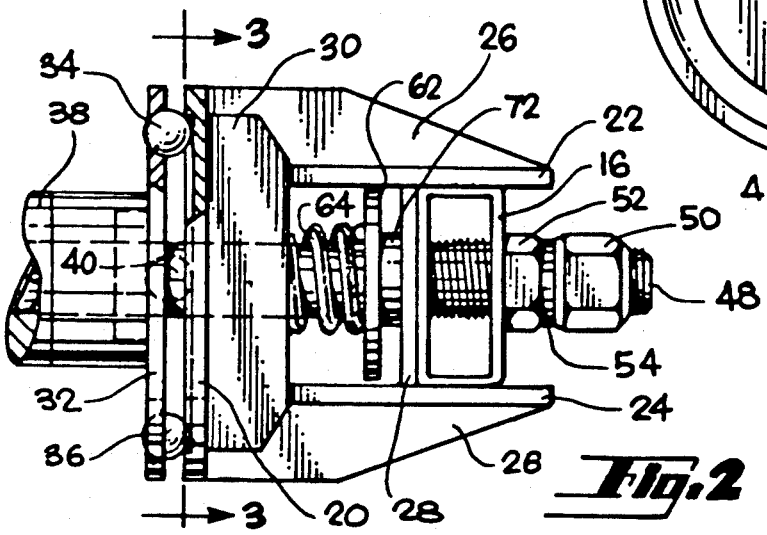
FIG. 2 is a top view of the practice device of FIG. 1 taken along lines 2—2.

Referring now to FIGS. 1 and 2, a fixed clutch plate 20 is mounted to the upper telescoping member 16 by a pair of mounting brackets 22 and 24. Other brackets 26, 28 and 30 which are welded to the mounting brackets are provided to add rigidity to the device. Adjacent to the fixed clutch plate is a rotatable clutch plate 32 having a pair of engagement balls 34 and 36 mounted thereto. Each of the two clutch plates 20 and 32 has a diameter of 4.5 inches and a thickness of 0.1875 inch. The clutch plates are made of mild steel. The engagement balls are made of steel and have a diameter of 0.75 inch. An axial tube 38 extends from the side of the rotatable clutch plate 32 opposite to the fixed clutch plate 20. The axial tube has a diameter of 2 inches. None of the dimensions or materials are critical to the present invention.

Figure 3:
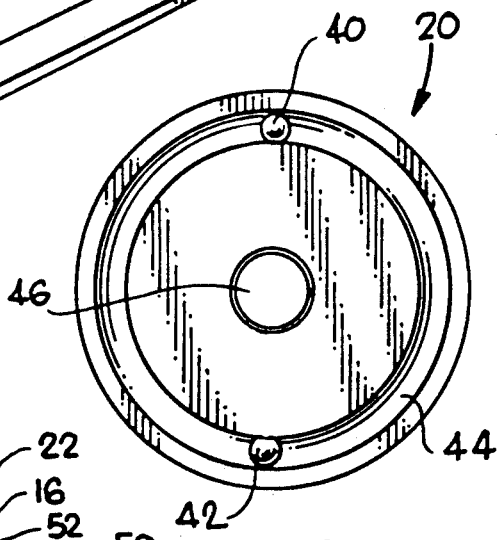
FIG. 3 is a side view of a fixed clutch plate of FIG. 2 taken along lines 3—3.

As best seen in FIG. 3, the surface of the fixed clutch plate 20 includes a pair of recesses 40 and 42. The recesses are dimensioned to receive the engagement balls 34 and 36 described above. Seating of the engagement balls within the recesses 40 and 42 indexes rest positions for the practice device. The rotary clutch plate 32 is shown in a condition in which the device is no longer in a rest position. Preferably, the rest position is one in which the plane intersecting the pair of engagement balls is a vertical plane.

When in the unseated condition shown in FIG. 2, the engagement balls 34 and 36 are within an annular runner 44, illustrated in FIG. 3. The annular runner provides smooth and secure motion of the rotatable clutch plate 32 relative to the fixed clutch plate 20. The annular runner 44, however, is not critical to the present invention.

The center of the fixed clutch plate 20 has a bore 46 which allows passage of a threaded member 48. A pair of nuts 50 and 52 are spaced apart by a lock washer 54 at one end of the threaded member. As best seen in FIG. 1, the externally-threaded member 48 passes through the device and is secured at its opposite end by a nut 56.

Figure 4:
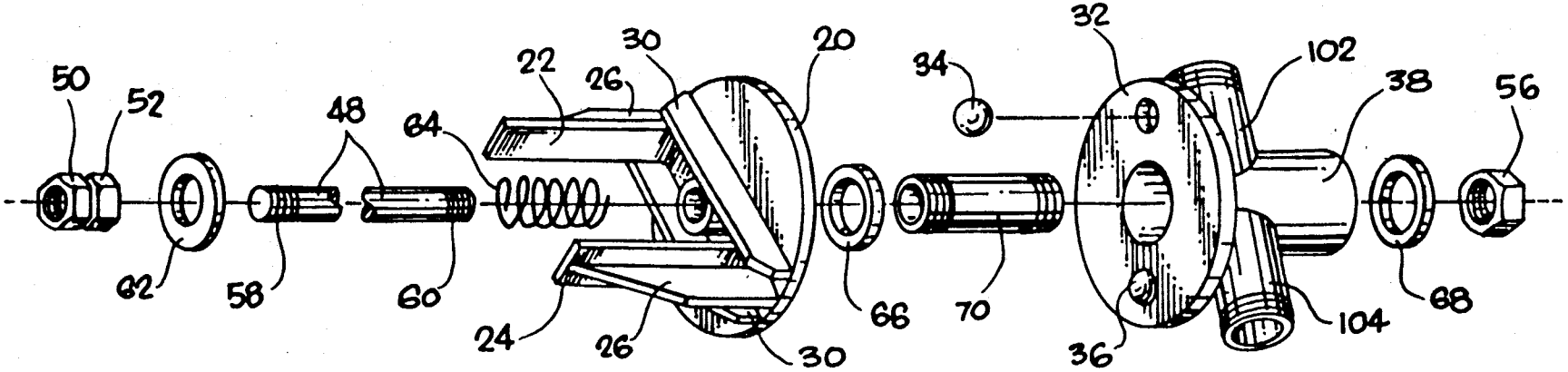
FIG. 4 is an exploded view of the clutch mechanism of FIG. 1.

The assembly of parts which allow relative rotation of the two clutch plates 20 and 32 is best described with reference to FIGS. 2 and 4. The pair of nuts 50 and 52 are threaded to a first end 58 of the threaded member 48 that passes through the device. At the opposite end 60 of the threaded member 48 is the nut 56. Along the length of the threaded member are a retaining member 62, a coil spring 64, a pair of rotary bearings 66 and 68, a sleeve 70 and the two clutch plates 20 and 32. The sleeve 70 has an inside diameter greater than the diameter of the threaded member 48. The opposite ends of the sleeve are received within the rotary bearings 66 and 68, thereby allowing rotation of the rotary clutch plate 32 relative to the threaded member 48. One rotary bearing 66 is secured at the clutch plate 32, while the other rotary bearing 68 is secured at the end of the axial tube 38 opposite to the clutch plate 32.

The two clutch plates 20 and 32 are biased into contact with one another by the coil spring 64. Referring to FIG. 2, the retaining member 62 is spaced apart from the bracket 28 by a sleeve 72. Tightening of the nuts 50 and 52 at the end of the threaded member 48 causes extraction of a portion of the threaded member to increase the bias of the rotary clutch plate 32 against the fixed clutch plate 20. The increase in bias increases the threshold torque required for dislodging the engagement balls 34 and 36 from a rest position within the recesses 40 and 42 of the fixed clutch plate 20. Thus, the device is adjustable for users of various ability.

The practice device 10 is shown in a rest position in FIG. 1. In this position first and second support arms 74 and 76 extend vertically. Each of the support arms has a practice ball 78 and 80 at an end opposite to the axial tube 38 that is fixed to the rotatable clutch plate 32. Upon disengagement of the rotatable clutch plate from the fixed clutch plate 20, the practice balls may be easily moved along an arc of 180 degrees to again lock the support arms 74 and 76 in a vertical rest position.

Figure 5:
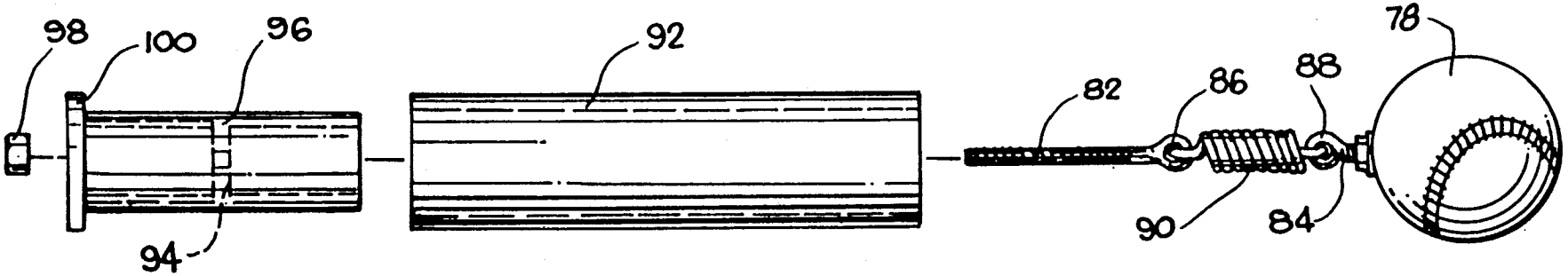
FIG. 5 is an exploded view of the ball-retaining assembly of FIG. 1.

With reference to FIG. 5, a support arm for mounting of a practice ball 78 utilizes a pair of externally-threaded members 82 and 84 having eyelet ends 86 and 88. The first externally-threaded member is fastened to the practice ball 78. A coil spring 90 connects the two eyelet ends 86 and 88. The second externally-threaded member 84 extends through a sleeve 92 and is fastened to a central plate 94 of a mounting member 96 by a nut 98. The sleeve 92 is made of a cushioning material, such as rubber, to receive misdirected swings of a bat. The mounting member 96 is made of a rigid metal. The mounting member 96 is internally threaded at an end closest to a flange 100. These threads fasten the support arm to external threads on one of the two cylindrical members 102 and 104 extended perpendicularly from the axial tube 38 shown in FIG. 4.

The coil 90 which connects the practice ball 78 to the remainder of the ball-hitting practice device serves the dual purpose of increasing the life of the device and providing a more natural feel of a bat striking a ball. Upon impact, the ball is able to momentarily depart from its position of axial alignment with the sleeve 92. This decreases the strain placed on the device and allows the ball to follow the natural path which would be followed by striking an unsupported ball by a particular swing. Since bat-to-ball contact typically lasts only 0.001 second, the spring 90 may be of the type which allows only slight relative movement between the practice ball 78 and the longitudinal axis of the sleeve 92 while still providing an improvement in the simulation of bat contact with a unsupported ball.

In operation, the practice device 10 is placed in the rest position shown in FIG. 1. A user can then swing a bat to impact the upper practice ball 78. Location of the engagement balls 34 and 36 within recesses 40 and 42 of the fixed clutch plate 20 acts to resist rotation of the practice balls about a horizontal axis defined by the threaded member 48. The resistance can be adjusted by tightening of the nuts 52 and 54 at one end of the threaded member 48. The device is adjusted so that disengagement from the rest position is effected only by a level swing by a particular user. At the very least, the adjustment should be made so that a swing which is not level cannot cause the dislodgement and the full 180 degree rotation of the practice ball.

The properly adjusted practice device 10 provides a clear indication of a level swing by a particular user. A level swing will cause the upper practice ball 78 to move from the elevated position of FIG. 2 to a position near the base member 12. Rotation beyond a 180 degree arc is prevented by reseating of the engagement balls 34 and 36 within recesses 40 and 42 of the fixed clutch plate 20. Thus, the device repositions itself for a second swing by a user. Rotation about a horizontal axis and the use of the coil spring 90 provide close simulation of a game-situation swing. This is furthered by use of a clutch action in which movement of the practice ball 78 parallel to the axis of rotation is minimal. Movement of the practice ball parallel to the generally horizontal axis defined by the threaded member 48 is limited to the distance in which the engagement balls 34 and 36 are received within the recesses 40 and 42.

While the present invention has been illustrated and explained as having two practice balls that rotate 180 degrees when properly impacted, the number of practice balls is not critical. For example, the device may be limited to a single practice ball that rotates 360 degrees.

I claim:

1. A ball hitting practice device, comprising, a frame and object to be struck, an elongated object support means attached to said frame for rotation about a generally horizontal axis, said object being attached at a first end of said object support means for rotation about said generally horizontal axis and within a generally vertical plane, torque releasable clutch means coupling said ball support means to said frame for locking said object support means in a predetermined position relative to said frame until a force at said first end provides a torque exceeding a threshold torque level, said clutch means having a fixed first member coupled to said frame and having a rotatable second member fixed to said object support means and selectively lockable relative to said first member, and limit means operatively associated with said first and second members for limiting said rotation of said ball support means from said rest position to a preselected maximum rotation not exceeding 360 degrees.

2. The device of claim 1 wherein said first and second members are parallel clutch plates, one of said clutch plates having at least one curved protrusion extending therefrom and the other of said clutch plates having a recess located to receive said at least one curved protrusion, said at least one curved protrusion when located within said recess providing an engagement for selectively locking of said object support means in said predetermined position.

3. The device of claim 2 wherein said clutch plate having said recess has an annular surface for contact with said curved protrusion when said curved protrusion is outside of said recess, thereby allowing smooth motion of said curved protrusion in either direction relative to said recess.

4. The device of claim 1 wherein said means for limiting said rotation includes an adjustable spring means for biasing said first and second members towards each other.

5. The device of claim 1 wherein said first and second members have facing parallel surfaces biased into contact, one of said facing surfaces having a pair of engagement balls and the other of said facing surfaces having a pair of recesses, said engagement balls and recesses disposed to provide rest stops of said object support means that are 180 degrees out of phase.

6. The device of claim 5 further comprising means for selectively adjusting said bias of said facing parallel surfaces.

7. The device of claim 5 wherein said object support means is a support arm having opposed ends, said support arm coupled to said clutch means at the center of said support arm, said object being a practice ball mounted on each of said opposed ends of said support arm.

8. A ball hitting practice device comprising, a ball, a first longitudinally extending support arm having a longitudinal axis and a ball fixed to a first end thereof, clutch means having a fixed clutch plate and a rotatable clutch plate for selectively securing said support arm being in a rest position, said support arm fixed to said rotatable clutch plate for guiding said ball about a rotational axis, said fixed clutch plate and said rotatable clutch plate having adjacent parallel surfaces, one of said surfaces having at least one curved protrusion and the other of said surfaces having at least one recess to receive said curved protrusion, thereby selectively securing said support arm in said rest position, spring means for selectively and adjustably biasing said rotatable clutch plate acurate said fixed plate, and support frame means coupled to said fixed clutch plate for securing said support arm at a level to allow pivoting of said arm about said rotational axis.

9. The device of claim 8 wherein said ball is fixed to said support arm by a spring biasing said ball against said first end.

10. The device of claim 8 further comprising a second longitudinally extending support arm having its longitudinal axis coincident with said longitudinal axis of said just support arm, said second support arm also being coupled to said rotatable clutch plate, said second support arm having a ball attached at an end distal said rotatable clutch plate.

11. The device of claim 10 wherein said at least one curved protrusion is a ball and wherein said clutch means has first and second rest positions defined by said ball on one of said surfaces being received in one of first and second recesses in said other surface, said first and second rest positions being 180 degrees out of phase relative to said rotation about said rotational axis.

12. The device of claim 8 wherein said ball is a baseball.

13. The device of claim 8 wherein said spring means includes a coil spring and a bracket abutting an end of said coil spring opposite to said clutch plates, said bracket being displaceable to allow adjustment of said force biasing said clutch plates into contact.

14. The device of claim 8 wherein said rotational axis is a generally horizontal axis.

15. A ball hitting practice device, comprising, a frame and a ball to be struck, an elongated ball support attached to said frame, said ball to be struck attached to a first end of said ball support for rotation of said ball about a generally horizontal axis and within a generally vertical plane, said first end being spaced apart from said generally horizontal axis, torque releasable clutch means coupling said ball support to said frame for locking said ball support in a predetermined rest position until a force at said first end provides a torque exceeding a threshold torque level, said clutch means having a fixed first member coupled to said frame and a rotatable second member attached to said ball support, means for selectively locking said second member to said fixed first member of said predetermined rest position, spring means for biasing said second member towards said first member, and means for selectively adjusting said spring means to vary said threshold torque level.

* * * * *

UNITED STATES PATENT AND TRADEMARK OFFICE

CERTIFICATE OF CORRECTION

PATENT NO. : 5,133,549

DATED : July 28, 1992

INVENTOR(S) : Joaquin C. Vasquez

It is certified that error appears in the above-identified patent and that said Letters Patent is hereby corrected as shown below:

Claim 8, column 6, line 39, "arcuate said fixed plate" should read - -towards said fixed plate- -.

Claim 10, column 6, lines 50-52, "said just support arm" should read - -said first support arm- -.

Claim 15, column 8, line 6, "member of said predetermined" should read - -member at said predetermined- -.

Signed and Sealed this

Tenth Day of August, 1993

*Attest:*

Michael K. Kirk

MICHAEL K. KIRK

*Attesting Officer*

*Acting Commissioner of Patents and Trademarks*